US010809038B2

(12) United States Patent
Geissele

(10) Patent No.: US 10,809,038 B2
(45) Date of Patent: Oct. 20, 2020

(54) FIREARM HANDGUARD ALIGNMENT METHODS AND SYSTEMS

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/138,315

(22) Filed: Sep. 21, 2018

(65) Prior Publication Data

US 2020/0096288 A1 Mar. 26, 2020

(51) Int. Cl.
*F41C 23/16* (2006.01)
*F41A 3/66* (2006.01)

(52) U.S. Cl.
CPC ..... *F41C 23/16* (2013.01); *F41A 3/66* (2013.01)

(58) Field of Classification Search
CPC ..... F41A 3/66; F41C 23/16; F41G 11/003
USPC ..... 42/71.01
See application file for complete search history.

(56) References Cited

U.S. PATENT DOCUMENTS 6,836,990 B2 * 1/2005 Shiloni ..... F41G 11/003 42/75.02
7,707,762 B1 * 5/2010 Swan ..... F41G 11/003 42/105
7,770,317 B1 * 8/2010 Tankersley ..... F41C 23/16 42/71.01
8,429,845 B1 * 4/2013 Swan ..... F41G 11/003 42/124
8,595,970 B2 * 12/2013 Picciotta ..... F41C 23/16 29/525.01
8,607,490 B1 * 12/2013 Zinsner ..... F41C 23/16 42/71.01
8,769,853 B1 * 7/2014 LaRue ..... F41C 23/16 42/71.01
8,863,426 B1 * 10/2014 Zinsner ..... F41C 23/16 42/71.01
8,904,691 B1 * 12/2014 Kincel ..... F41C 23/16 42/71.01
8,931,196 B1 * 1/2015 Larue ..... F41A 11/04 42/71.01
D747,426 S * 1/2016 Cheng ..... D22/108
9,453,694 B1 * 9/2016 Storch ..... F41A 3/64
9,476,672 B2 * 10/2016 Wells ..... F41C 23/16
9,528,793 B1 * 12/2016 Oglesby ..... F41C 23/16
9,599,430 B1 * 3/2017 Geissele ..... F41C 23/16
9,658,020 B2 * 5/2017 Daniel ..... F41A 21/485
9,683,808 B2 * 6/2017 Gagnon ..... F41C 23/16
(Continued)

*Primary Examiner* — Stephen Johnson
*Assistant Examiner* — Benjamin S Gomberg
(74) *Attorney, Agent, or Firm* — Fox Rothschild LLP

(57) ABSTRACT

Firearm handguard systems are disclosed, including rail alignment systems and anti-rotational firearm handguard systems. Also disclosed is a method of aligning a rail portion provided on an upper outer surface of a handguard using a handguard key that aligns the rail portion of the handguard with a rail portion of a firearm. Also disclosed is a firearm having a rail alignment system, and a handguard having a handguard key, wherein the handguard key is integrally formed with the handguard or is a modular handguard key configured to be removably attached to the handguard.

20 Claims, 8 Drawing Sheets

(56) References Cited

U.S. PATENT DOCUMENTS

| | | | | |
|---|---|---|---|---|
| 9,791,239 | B1 * | 10/2017 | Kincel | F41C 23/16 |
| 10,240,892 | B2 * | 3/2019 | Leitner-Wise | F41A 3/66 |
| 10,260,838 | B1 * | 4/2019 | Kincel | F41C 23/16 |
| 10,352,650 | B2 * | 7/2019 | Hiler, Jr. | |
| 10,619,971 | B2 * | 4/2020 | Hubbell | F41C 23/16 |
| 10,648,757 | B2 * | 5/2020 | Wheeler | F41A 5/26 |
| 2012/0317859 | A1 * | 12/2012 | Brown | F41A 3/66<br>42/71.01 |
| 2014/0026459 | A1 * | 1/2014 | Yan | F41C 23/16<br>42/71.01 |
| 2017/0023329 | A1 * | 1/2017 | Gottzmann | F41C 23/16 |
| 2018/0356181 | A1 * | 12/2018 | Williams | F41C 23/16 |

* cited by examiner

FIREARM HANDGUARD ALIGNMENT METHODS AND SYSTEMS

BACKGROUND

Firearm handguards are designed to protect a user from being burned due to contact with the hot barrel of a firearm. Conventional handguards can be used to facilitate the connection of weapon accessories (e.g., optics, laser, night vision, foregrips, bipods, tactical lights, etc.) to the firearm.

When a handguard is mated to an upper receiver, the rail (e.g., a Picatinny rail) on the handguard must be manually aligned with the rail on the upper receiver before securing the handguard to the firearm. However, the handguard can rotate in a clockwise or counterclockwise manner around a portion of the barrel of the firearm, making it difficult to manually align the handguard and upper receiver, including instances where the handguard has a rail that must align with the rail on the outer surface of the upper receiver. A user may need to use a secondary device (e.g., a detachable carry handle) to align the rails, but this alignment method is time consuming and requires additional equipment and may not suitably prevent handguard rotation. A user may also align the rails by sight; however, this method does not utilize proper measurements, typically resulting in misaligned rails, and also does not prevent rotation.

There is a need to facilitate the coupling of a handguard to a firearm.

SUMMARY

The present disclosure relates generally to firearm rail systems, and more particularly, to alignment and anti-rotational firearm rail systems.

In one aspect, the disclosed technology relates to a method of aligning a rail portion provided on an upper outer surface of a handguard, the method including: inserting a handguard key into a receiving portion of the handguard such that a proximal end portion of the handguard key interlocks with the receiving portion and a distal end portion of the handguard key projects beyond a back end of the handguard; and mounting the handguard to a firearm such that the distal end portion of the handguard key interlocks with an outer surface of the firearm, wherein when the handguard is mounted to the firearm, the handguard key aligns the rail portion of the handguard with a rail portion provided on an upper, outer surface of the firearm. In one embodiment, the handguard is mounted to the firearm, the handguard key prevents the handguard from rotating in a circumferential direction around a longitudinal axis of the handguard. In another embodiment, the method further includes fastening the handguard key to the receiving portion via a fastening member. In another embodiment, the distal end portion of the handguard key includes at least two end portions, each extending outwards from a central body of the handguard key, and wherein the at least two end portions are configured to engage the outer surface of the firearm. In another embodiment, the rail portion of the firearm includes a Picatinny rail. In another embodiment, a portion of an upper surface of the distal end portion of the handguard key lies on a plane parallel with the outer surface of the firearm.

In another aspect, the disclosed technology relates to a firearm having a rail alignment system, the system including: a receiver having a receiver rail portion provided on an upper, outer surface of the receiver; and a handguard coupled to the receiver, wherein the handguard includes: an elongate member including a central bore defining a longitudinal axis of the handguard; a rail portion provided on an upper, outer surface of the elongate member; and a handguard key provided on a back end of the elongate member, the handguard key having at least two end portions projecting away from the elongate member, wherein the at least two end portions of the handguard key are configured to engage the outer surface of the receiver such that the rail portion of the elongate member is aligned with the receiver rail portion. In one embodiment, the handguard key is a modular handguard key configured to be removably attached to the handguard. In another embodiment, the handguard is integrally formed with the handguard key, such that the handguard key and the handguard are of a unitary body. In another embodiment, the at least two end portions projecting away from the elongate member are further configured to prevent the handguard from rotating in a circumferential direction around the longitudinal axis of the handguard. In another embodiment, the handguard further includes one or more tabs provided on the back end of the elongate member, the one or more tabs being configured to engage the outer surface of the receiver and to prevent the end portions of the handguard key from bending in a direction that is not parallel with the longitudinal axis of the handguard. In another embodiment, an upper surface of the end portion of the handguard key lies on a plane parallel with a bottom surface of the receiver rail portion. In another embodiment, an upper surface of the end portion of the handguard key is formed at an angle of about 45 degrees and faces the receiver rail portion.

In another aspect, the disclosed technology relates to a handguard having an integral handguard key for a firearm, the handguard including: an elongate member including a central bore defining a longitudinal axis of the handguard; a rail portion provided on an upper, outer surface of the elongate member; and the integral handguard key provided on a back end of the elongate member, the integral handguard key having at least two end portions projecting away from the elongate member, wherein when the handguard is mounted to the firearm having a rail portion provided on an upper, outer surface of the firearm, the at least two end portions of the integral handguard key are configured to engage the outer surface of the firearm such that the rail portion of the elongate member is aligned with the rail portion of the firearm. In one embodiment, the handguard is integrally formed with the integral handguard key, such that the integral handguard key and the handguard are of a unitary body. In another embodiment, when the at least two end portions are engaged with the outer surface of the firearm, the at least two end portions are further configured to prevent the handguard from rotating in a circumferential direction around the longitudinal axis of the handguard. In another embodiment, an upper surface of the end portion of the handguard key lies on a plane parallel with a bottom surface of the rail portion of the firearm.

In another aspect, the disclosed technology relates to a handguard for a firearm, the handguard including: an elongate member including a central bore defining a longitudinal axis of the handguard; and an handguard key provided on a back end of the elongate member, the handguard key having at least two end portions projecting away from the elongate member, wherein when the handguard is mounted to the firearm having a rail portion provided on an upper, outer surface of the firearm, the at least two end portions of the handguard key are configured to lie on a plane parallel with a bottom surface of the rail portion, and wherein the at least two end portions projecting away from the elongate member are further configured to prevent the handguard from rotating in a circumferential direction around the longitudinal axis of the handguard. In one embodiment, the handguard is integrally formed with the handguard key, such that the handguard key and the handguard are of a unitary body. In another embodiment, the handguard key is a modular handguard key configured to be removably attached to the handguard.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE FIGURES

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1:
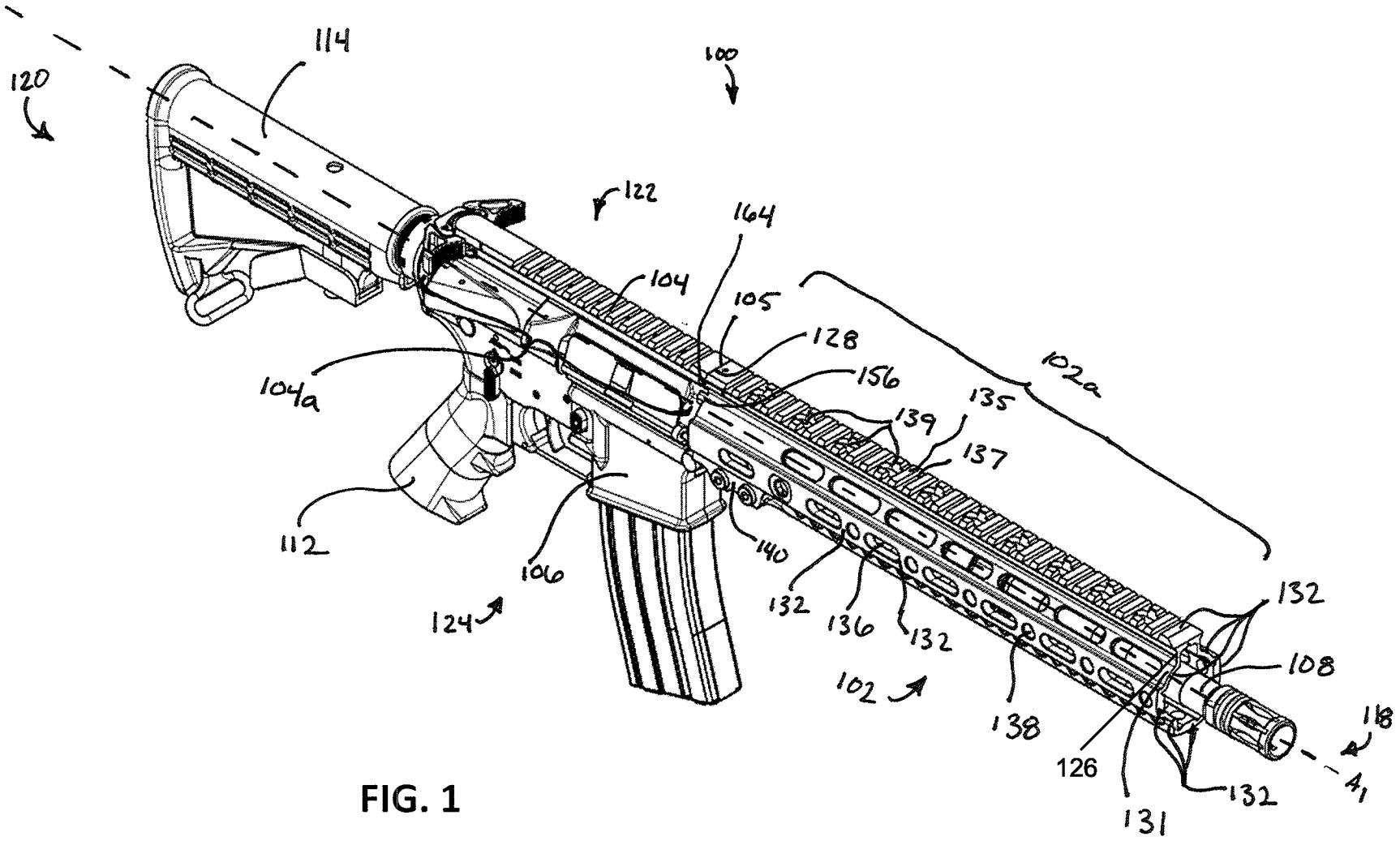
FIG. 1 illustrates a perspective view of an example firearm including an example handguard.

The following discussion omits or only briefly describes conventional features of firearms, such as trigger and firing mechanisms, which are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "comprises" and/or "comprising," when used in this specification, specify the presence of stated features, elements, and/or components, but do not preclude the presence or addition of one or more other features, steps, operations, elements, components, and/or groups thereof.

Embodiments of the present disclosure relate generally to firearm rail systems, and more particularly, to alignment and anti-rotational firearm rail systems. Embodiments of the firearm rail systems are described below with reference to FIGS. 1-7.

FIG. 1 illustrates a perspective view of an example firearm 100 including an example handguard 102, according to some embodiments of the present disclosure.

The firearm 100 includes at least one of a handguard 102, an upper receiver 104 having a front end 105, a lower receiver 106, a barrel 108, a grip 112, and a stock 114. The firearm 100 is defined by a front 118, a back 120, a top 122 and a bottom 124. Throughout this disclosure, references to orientation (e.g., front, frontward, rear, rearward, in front, behind, above, below, high, low, back, top, bottom, under, underside, etc.) of structural components shall be defined by that component's positioning in FIG. 1 relative to, as applicable, the front 118, the back 120, the top 122, and the bottom 124 of the firearm 100, regardless of how the firearm 100 may be held and regardless of how that component (e.g., the handguard 102) may be situated on its own (i.e., separated from the firearm 100).

The handguard 102 includes a front end 126, a back end 128, and an elongate member 129 disposed between the front end 126 and the back end 128. In some embodiments, the handguard 102 includes a rail portion 102*a*, such as a Picatinny rail, which may be integrally formed with the handguard. The handguard 102 also includes a longitudinal bore 130 within the elongate member 129, in which the longitudinal bore 130 extends from the back end 128 to the front end 126. An outer surface 131 of handguard 102 has a plurality of sides 132, a plurality of apertures 136, and a plurality of fastener receivers 138. The handguard may also include a firearm coupling portion 140 to couple the handguard to the upper receiver 104. In one or more embodiments, the handguard 102 can be one of a variety of shapes, such as a quad shape (e.g., a quad rail), a cylindrical shape, or other shapes of handguards known to those of ordinary skill in the art.

The firearm 100 can be of a variety of types. For example, the firearm may be a handgun, rifle, shotgun, carbine, or personal defense weapon. In at least one embodiment, the firearm 100 is implemented as an M4 carbine or a variant of an M4 carbine.

The upper receiver 104 is configured to house a bolt assembly. In firearm 100, the bolt assembly is slidably disposed in the upper receiver 104 for axially reciprocating recoil movement therein during the firing cycle sequence of the firearm 100. In some embodiments, the upper receiver 104 includes a rail portion 104*a* configured to facilitate mounting of accessories (e.g., a foregrip, a flashlight, a laser, optic equipment, etc.) to the firearm 100. In one or more embodiments, the rail portion 104*a* can be an integral part of the upper receiver 104. In other embodiments, the rail portion 104*a* can be modular, i.e., attachable to and removable from the upper receiver 104 with one or more fasteners (e.g., screws, bolts, pins, etc.) that mate to the upper receiver 104. In one or more embodiments, the rail portion 104*a* utilizes the same mounting platform as rail portion 102*a*. In some embodiments, the rail portion 104*a* is a mounting platform such as a Picatinny rail, also known as a MIL- STD-1913 rail. In other embodiments, the rail portion 104*a* is another type of mounting platform known by one of ordinary skill in the art. In some embodiments, the handguard 102 does not include a rail portion 102*a*. The lower receiver 106 is configured to house a trigger mechanism configured to initiate the firing cycle sequence of the firearm 100 when the trigger is pulled. The barrel 108 is configured to be mated to the upper receiver 104.

The handguard 102 surrounds at least a portion of the barrel 108 and functions as a support for the user's front hand when firing the firearm 100. The handguard 102 may also act to protect the user's hand from getting burned by the barrel 108, which can become extremely hot upon firing the firearm 100. The handguard 102 may also be used for mounting accessories—e.g., a foregrip, a flashlight, a laser, optic equipment, etc.

The elongate member 129 has a unitary construction, and can be constructed from an extruded aluminum or other metal that is subsequently machined. The handguard 102 may be of the free-floating type. In other words, transfer of the forces applied to the handguard via the user's hand or, for example, a bipod, to the barrel are minimized. This free-floating construction allows for more accurate shooting. It should be appreciated that many other alternative configurations are also possible (e.g., multiple piece construction, non-free floating constructions, non-metal constructions, alternative metal constructions, etc.).

In some embodiments, a rear portion of the handguard 102 (i.e., the firearm coupling portion 140) is mounted to at least one of the upper receiver 104 and the barrel 108. In other embodiments, the firearm coupling portion 140 may be fastened to the front end 105 of the upper receiver 104, or to a portion of the barrel 108. In other embodiments, the firearm coupling portion 140 is mounted to the barrel 108 via a barrel nut such that the back end 128 of the handguard 102 abuts the front end 105 of the upper receiver 104; and the portion of the handguard 102 that is forward of the barrel nut may be cantilevered off the barrel nut.

In some embodiments, the sides 132 (which can include, top, bottom, right and left sides, as well as one or more sides between adjacent pairs of the top, bottom, right, and left sides) of the outer surface 131 of the handguard 102 provide surfaces that the user can ergonomically grip. In other embodiments, the outside surface 131 can be rounded (e.g., cylindrical) or portions thereof can be rounded to provide an ergonomic grip.

The apertures 136 are disposed in one or more of the sides 132 of the elongate member 129 of the handguard 102. The apertures 136 may reduce the weight of the handguard 102, and also serve as heat vents. The apertures 136 allow heat, radiating from the barrel 108 as a result of shooting the firearm 100, to escape, thereby minimizing excessive heat build-up between the handguard 102 and the barrel 108. The apertures 136 can be used to receive components (such as lugs) of accessories to facilitate securing of the accessories to the handguard 102—for example, by aligning the accessory with the appropriate fastener receivers 138. The number, size, shape, and distribution of the apertures 136 can be adjusted or customized for particular firearms, accessories, or other requirements, and the same handguard can include apertures 136 of different sizes and/or shapes.

The rail portion 102*a* of the handguard 102 may be disposed on one or more of the sides 132. The rail portion 102*a* facilitates mounting of accessories (e.g., a foregrip, a flashlight, a laser, optic equipment, etc.) to the firearm 100. In some embodiments, the rail portion 102*a* can be an integral part of the elongate member 129. In other embodiments, the rail portion 102*a* can be modular, i.e., attachable to and removable from the elongate member 129, e.g., with fasteners (e.g., screws, bolts, pins, etc.) that mate with the fastener receivers 138. In some embodiments, the rail portion 102*a* includes mounting ribs 135, which may alternate with grooves 137, and fastener holes 139. The mounting ribs 135 with their corresponding grooves 137 provide an engagement surface for mounting firearm accessories having corresponding ribs and grooves that engage the grooves 137 and mounting ribs 135, respectively. In one example, the rail portion 102*a*, including the mounting ribs 135 and the grooves 137, may use a standard dimension platform, such as a Picatinny style mounting platform, also known as a Picatinny rail and/or MIL-STD-1913. It is noted that the Picatinny style mounting platform is an illustrative example, and the rail portion 102*a* may have dimensions and styles of other types of mounting platforms known by one of ordinary skill in the art. In other embodiments, the handguard 102 does not include the rail portion 102*a*.

The fastener holes 139 and the fastener receivers 138 are configured to receive fasteners, such as fasteners 141, for securing one or more accessories to the handguard 102. In some examples, the fastener holes 139 and/or the fastener receivers 138 are threaded in order to receive correspondingly threaded screw fasteners.

Figure 2:
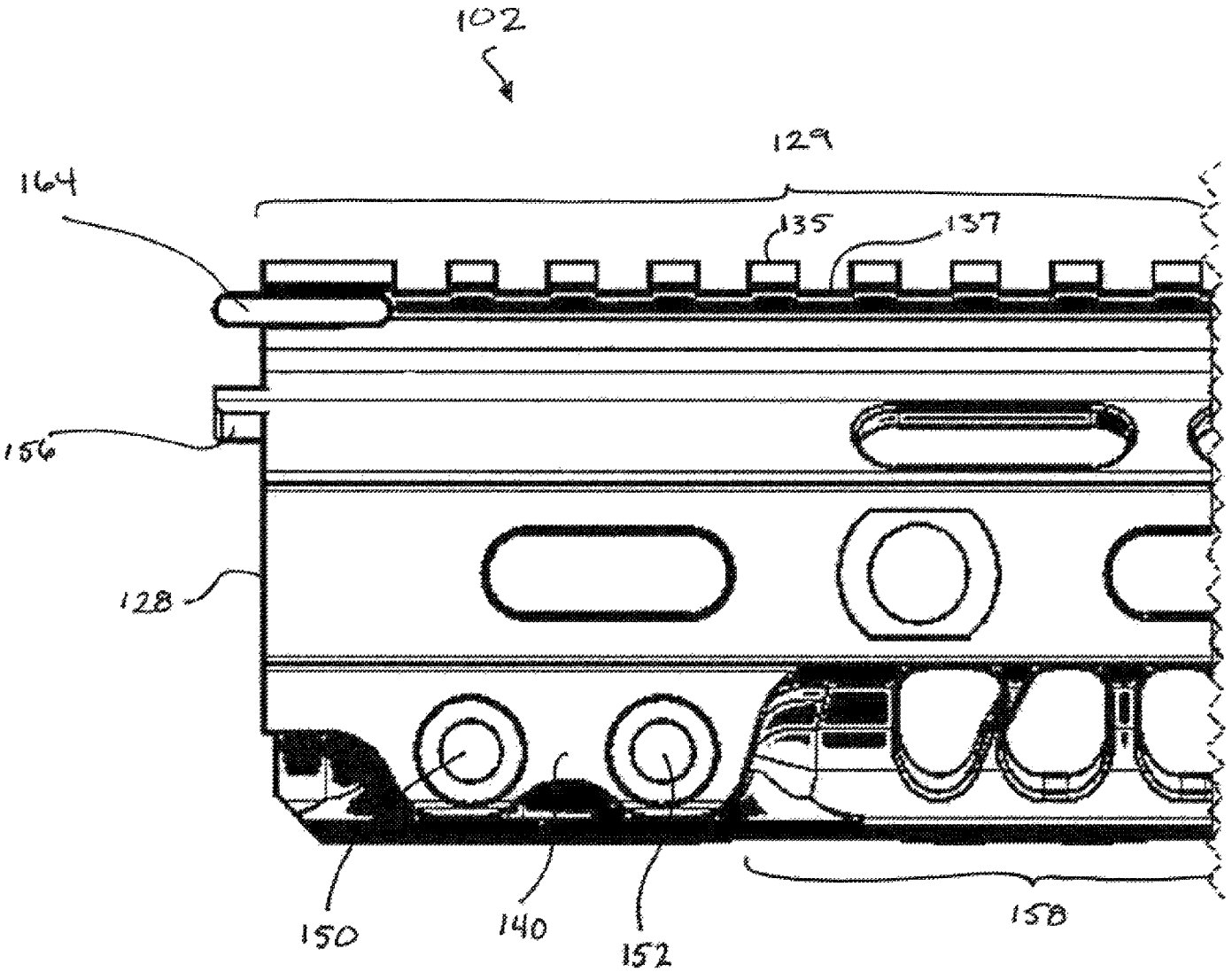
FIG. 2 illustrates a perspective view of a portion of the handguard of FIG. 1 in an unassembled configuration.

FIG. 2 illustrates a perspective view of a portion of the handguard 102 of FIG. 1 in an unassembled configuration, according to some embodiments of the present disclosure.

The firearm coupling portion 140 includes a first coupler receiver 150 and a second coupler receiver 152. The firearm coupling portion 140 is disposed towards the back end 128 of the handguard 102 and extends downward from the elongate member 129 such that the bottom of the firearm coupling portion 140 is lower than the bottom side 158 of the elongate member 129. In some embodiments, the firearm coupling portion 140 is configured to facilitate positioning and stabilization of the firearm 100 for shooting (e.g., by resting one or more depressions (not shown) and/or one or more grooves (not shown) of the firearm coupling portion 140 on corresponding components of a bipod for target practice or a shooting competition). In some embodiments, the depressions and the groove can be customized in number, size, shape, depth, and/or placement for aesthetics and/or in accordance with the intended apparatus (e.g., a bipod) to which they are rested on and/or coupled to.

In some embodiments, the first coupler receiver 150 and the second coupler receiver 152 are each configured to receive coupling mechanisms (e.g., bolts, screws, pins) to fasten the handguard 102 to the remaining portions of the firearm 100, preventing detachment of the handguard 102 from the firearm 100. In some embodiments, the coupling mechanisms extend from one side of the firearm coupling portion 140, through the entirety of the first coupler receiver 150 and the second coupler receiver 152 (i.e., laterally across the width of the firearm coupling portion 140), and reversibly secured in place (e.g., with a nut) on an opposite side of the firearm coupling portion 140.

In some embodiments, one or more reinforcement tabs 156 project rearwards from the back end 128 of the handguard 102. When the handguard 102 is mounted to the upper receiver 104, the reinforcement tabs 156 engage the outer surface of the upper receiver 104 on the respective side of the top 122 of the firearm 100, thereby stabilizing the handguard 102 by minimizing rotational movement about longitudinal axis A1 of the handguard 102 relative to the upper receiver 104. Moreover, in some embodiments, the one or more reinforcement tabs 156 are configured to reinforce end portions of a handguard key, such as end portions 165 of handguard key 164 shown in FIG. 3, to prevent the end portions from bending in an outward or inward direction such that the end portions would no longer be in a direction parallel with the longitudinal axis A1 of the handguard 102. In some embodiments, the one or more reinforcement tabs 156 extends a length of about 0.05 inches to about 0.2 inches, such as about 0.0625 inches to about 0.125 inches, from the back end 128 of the handguard 102.

Figure 3A:
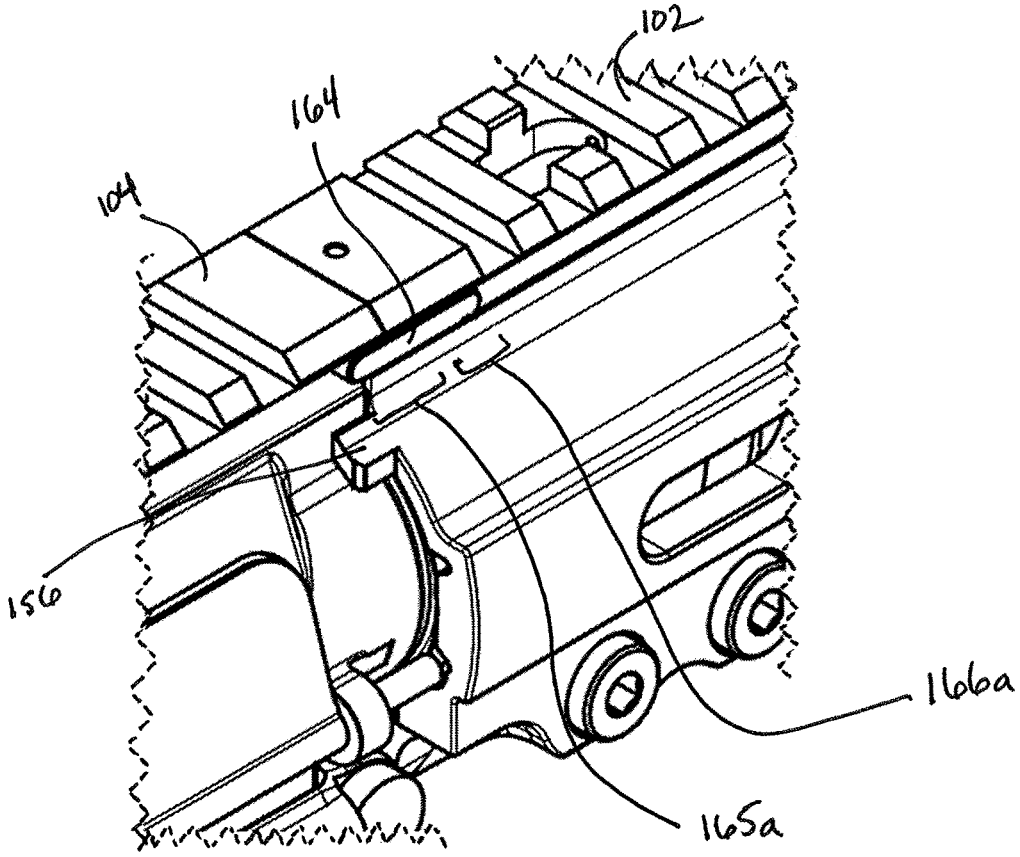
FIG. 3 illustrates additional perspective views, via FIGS. 3A, 3B, and 3C, of the handguard with a handguard key of FIG. 1 in an unassembled configuration.
Figure 3B:
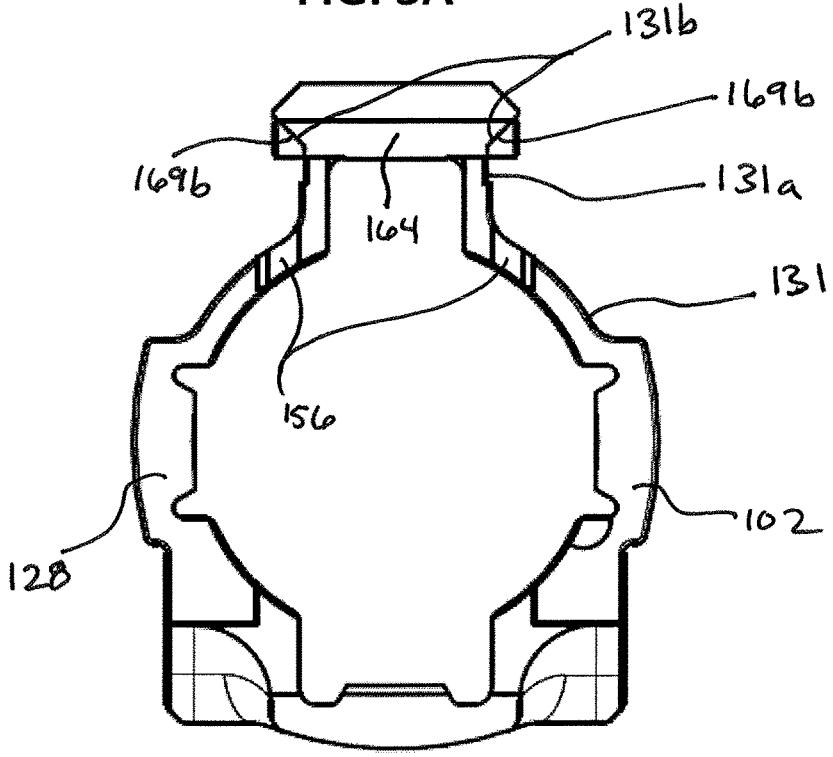
Figure 3C:
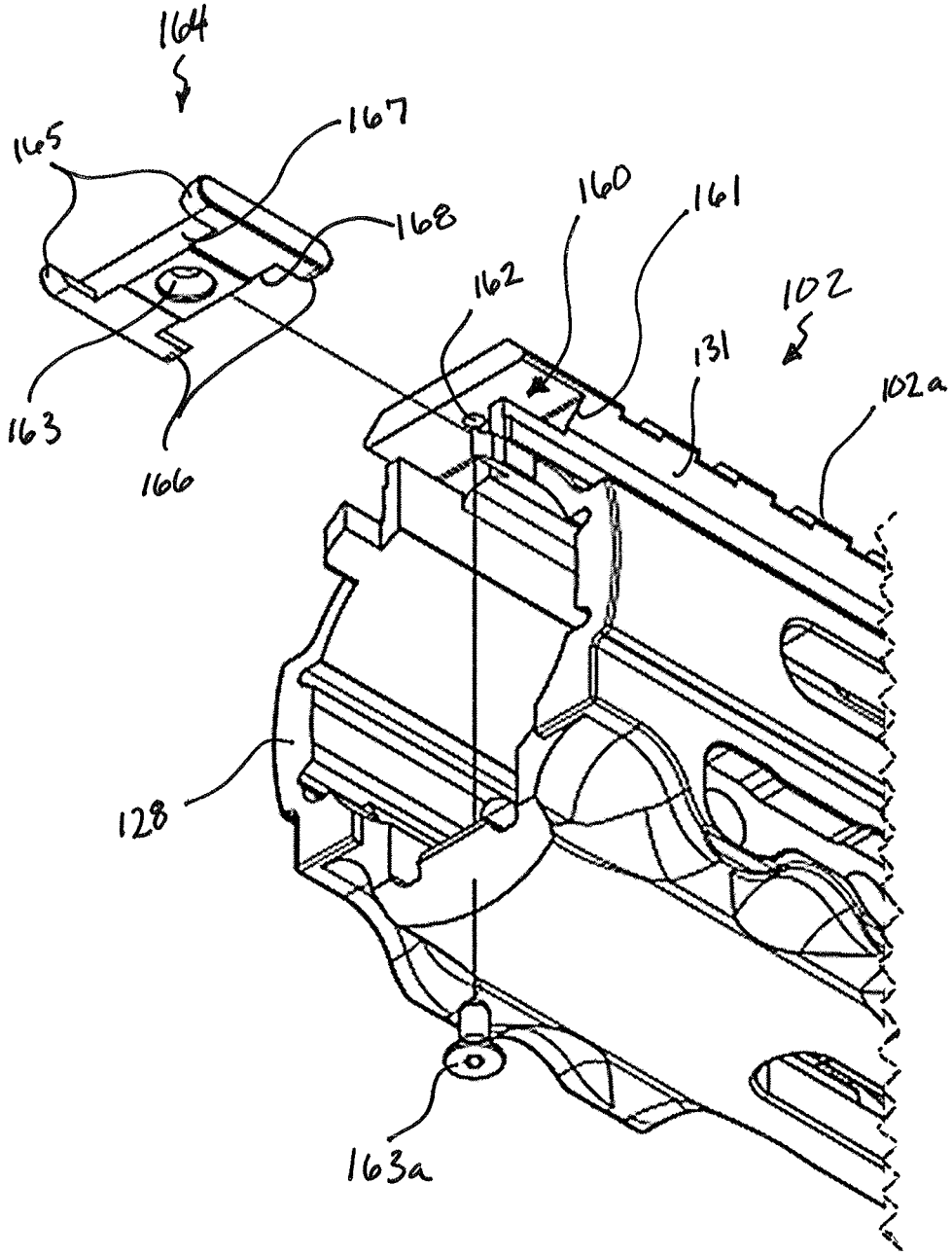
Figure 4A:
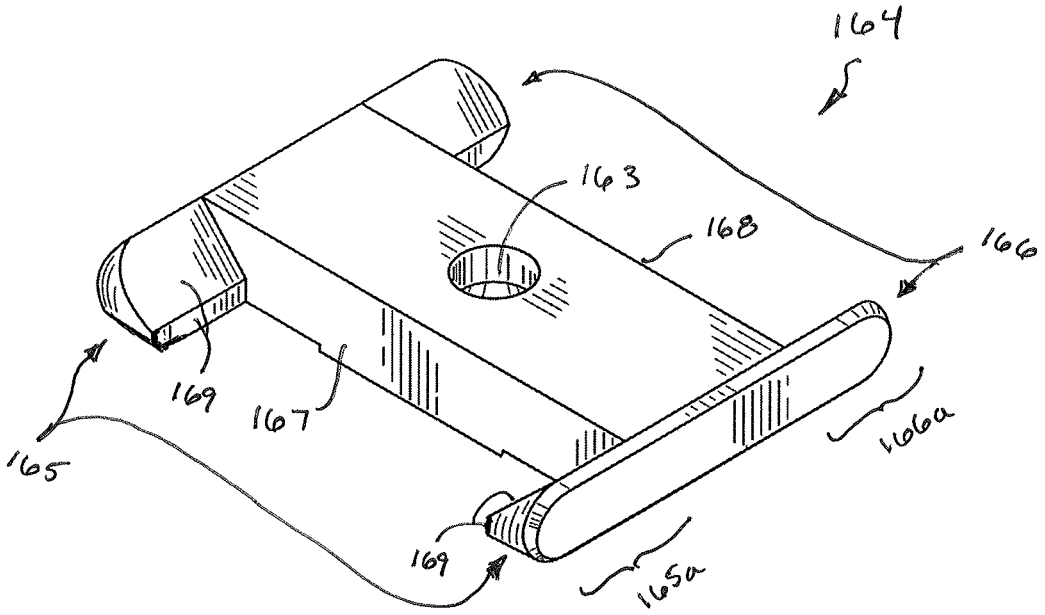
FIG. 4A illustrates a perspective view of the handguard key of FIG. 1.
Figure 4B:
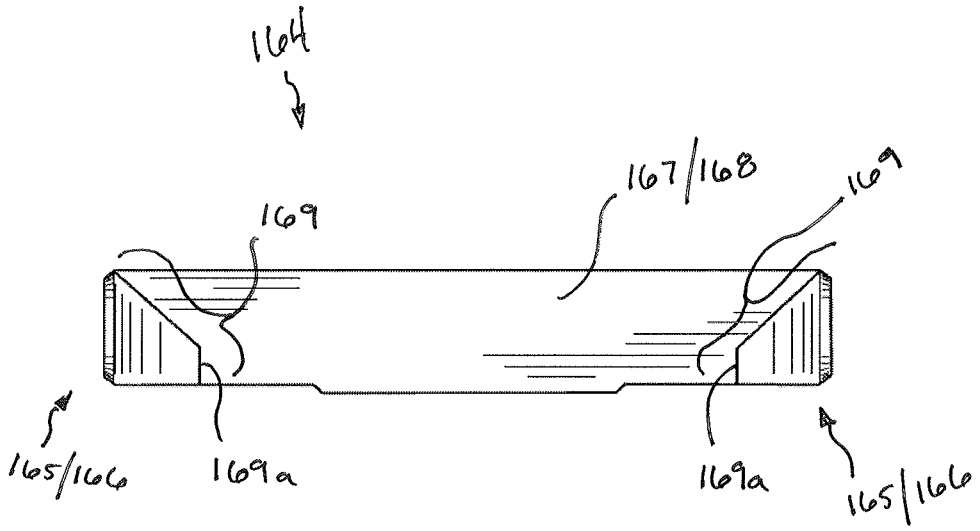
FIG. 4B illustrates a side view of the handguard key of FIG. 1.

FIG. 3 illustrates additional perspective views, via FIGS. 3A, 3B, and 3C, of the handguard 102 with a handguard key 164 of FIG. 1 in an assembled configuration (FIG. 3A being an enlarged isometric view of the handguard key 164, and FIG. 3B being a rear view of the handguard 102 with the handguard key 164 inserted into the handguard 102) and in an unassembled configuration (FIG. 3C being an isometric exploded view of the handguard 102 and handguard key 164), according to some embodiments of the present disclosure. FIG. 4A illustrates a perspective view of the handguard key 164 of FIG. 1, according to some embodiments of the present disclosure. FIG. 4B illustrates a side view of the handguard key 164 of FIG. 1, according to some embodiments of the present disclosure. In some embodiments, the handguard key 164 is at least partially ornamental in nature.

In some embodiments, the handguard key 164 is a modular key configured to be fastened and unfastened to the handguard 102. The handguard key 164 may be inserted into the handguard key receiving portion 160. Upon inserting the handguard key 164 into the handguard key receiving portion 160, a screw 163*a* (or other suitable fastener) may be inserted into the hole 163 and into the screw hole 162 configured to receive the screw 163*a*. The screw 163*a* may be tightened into the screw hole 162, thereby fastening the handguard key 164 to the handguard 102. In some embodiments, when the handguard key 164 is inserted into the handguard key receiving portion 160, end portions 165 and 166 extend in a direction parallel with the longitudinal axis A1 of the handguard 102.

In some embodiments, end portions 166 of the handguard key 164 are each configured to be positioned over the outside surface 131 of the handguard 102. In other embodiments, end portions 165 of the handguard key 164 are each configured to be positioned over the outside surface 131 of the handguard 102. Either end portions 166 or end portions 165, which extend over the respective outside surface of the handguard 102, interlock the handguard key 164 with the handguard 102, preventing the handguard key 164 from moving in a lateral direction of the handguard 102.

The following discussion will be described in which the end portions 166 are positioned over the outside surface 131 of the handguard 102; however, it should be noted that the following discussed features are equally applicable to embodiments in which the end portions 165 are positioned over the outside surface 131 of the handguard 102. For example, when end portions 166 are positioned over the outside surface 131, at least a portion 165*a* of the end portions 165 protrude beyond the back end 128 of the handguard 102. Similar, when end portions 165 are positioned over the outside surface 131, at least a portion 165*b* of the end portions 166 protrude beyond the back end 128 of the handguard 102

In some embodiments, while the handguard key 164 is fastened to the handguard 102 or is at least inserted into the handguard key receiving portion 160 but not yet fastened, a portion 165*a* of end portions 165 protrudes rearward and beyond the back end 128 of the handguard 102. In some embodiments, the surface 167 of the handguard key 164 is flush or about flush with the surface of the back end 128. In some embodiments, when the handguard key 164 is inserted into the handguard key receiving portion 160, the surface 167 and the surface of the back end 128 form a flat surface. In some embodiments, when the handguard 102 is mounted to the upper receiver 104, a portion 165*a* of end portions 165 that protrudes rearward engages the outer surface of the upper receiver 104 on the respective side of the top 122 of the firearm 100, thereby aligning the rail portion 104*a* of the upper receiver 104 with the rail portion 102*a* of the handguard 102 and preventing the handguard 102 from rotating in a circumferential direction around the longitudinal axis A1 of the handguard 102.

In other embodiments, the upper receiver 104 includes the receiver rail portion 104*a* and the handguard 102 does not include a rail portion. In such embodiments, the end portions 165 of the handguard 102 engage the rail portion 104*a* of the upper receiver 104 and prevent the handguard 102 from rotating in a circumferential direction around the longitudinal axis A1 of the handguard 102. The upper surface portion 169*b* of the end portions 165 may lie on a plane parallel with a bottom outer surface 131*b* of the rail portion 104*a* of the upper receiver 104.

In one or more embodiments, the portions 165*a* each extend from the surface 167 of the handguard key 164 a length of about 0.05 inches to about 1 inch, such as about 0.06 inches to about 0.5 inches, or about 0.0625 inches to about 0.125 inches. In one or more embodiments, the portions 166*a* each extend from the surface 168 of the handguard key 164 a length of about 0.05 inches to about 1 inch, such as about 0.06 inches to about 0.5 inches, or about 0.0625 inches to about 0.125 inches. In one or more embodiments, the portions 165*a* and the portions 166*a* are each configured to cover an outer surface of the upper receiver 104 and an outer surface 131 of the handguard 102 by a length of about 0.05 inches to about 1 inch, such as about 0.06 inches to about 0.5 inches, or about 0.0625 inches to about 0.125 inches, respectively. In some embodiments, the portions 165 are spaced a minimum of 0.617 inches apart from one another. In some embodiments, the portions 166 are spaced a minimum of 0.617 inches apart from one another.

In some embodiments, the minimum spacing for the portions 166 and for the portions 165 may have a tolerance in accordance with U.S. military standards for dimensions of accessory mounting rails. See, e.g., Military Standard, "Dimensioning of Accessory Mounting Rail for Small Arms Weapons" (Feb. 3, 1995), hereby incorporated by reference in its entirety. In some embodiments, the upper surface portion 169*b* is configured at an angle of about 45 degrees to match the corresponding U.S. military standard angle of the bottom outer surface 131*b*.

Each end portion 165 and 166 may be configured in a variety of shapes, including but not limited to a "D" shape, a cylindrical or partial cylindrical shape, a rectangular or partial rectangular shape, or other polyhedron shape. In some embodiments, each end portion, such as end portions 165 and 166, is configured with a variety of shaped interior surfaces, such as interior surface portion 169. In some embodiments, the interior surface portion 169 is shaped to match a respective outer surface of the upper receiver 104 and/or the outer surface 131 of the handguard 102, such that when the handguard key 164 is inserted into the handguard key receiving portion 160 or when the handguard 102 is mounted to the upper receiver 104, the interior surface portion 169 interlocks with the respective outer surface of the upper receiver 104 and/or the outer surface 131 of the handguard 102. The bottom outer surface 131*b* includes a bottom surface of the elongated portion 129, for example the bottom surface of the Picatinny rail. The vertical outer surface 131*a* includes a vertical side surface of the handguard 102. In some embodiments, the outer surface of the upper receiver 104 and the outer surface 131 of the handguard 102 have the same shape, such that the interior surface 169 of the end portions 165 and 166 all have the same shape, allowing either end portion 165 or end portion 166 of the handguard key 164 to be interlocked with the handguard key receiving portion 160 and the opposite end to be interlocked with the outer surface of the upper receiver 104. In some other embodiments, the interior surface portion 169 can have one of a fillet edge, a chamfered edge, a beveled edge, a rounded edge, or other types of surfaces or edges known to one of ordinary skill in the art. In one or more embodiments, the upper surface portion 169*b* is configured to contact the bottom outer surface 131*b*. The upper surface portion 169*b* may lie on a plane parallel with a plane of the bottom outer surface 131*b*. In some embodiments, the vertical surface portion 169*a* of the interior surface portion 169 may be configured to contact a respective outer surface of the upper receiver 104 or the vertical outer surface 131*a* of the handguard 102.

In some embodiments, by interlocking both ends of the handguard key 164 with the respective outer surfaces of the upper receiver 104 and handguard 102, the rail portions 104*a* of the upper receiver 104 and the rail portion 102*a* of the handguard 102 are automatically aligned when the handguard 102 and the upper receiver 104 are mounted to one another. In some embodiments, by interlocking both ends of the handguard key 164 with the respective outer surfaces of the upper receiver 104 and handguard 102, the handguard 102 is prevented from rotating in a clockwise or counterclockwise manner around a portion of the barrel 108 of the firearm 100. In other embodiments, in which the upper receiver 104 includes a receiver rail portion 104*a* and the handguard 102 does not include a rail portion, the handguard 102 is prevented from rotating in a clockwise or counterclockwise manner around a portion of the barrel 108 of the firearm 100. In some embodiments, when the handguard 102 is interlocked with the upper receiver 104 via the handguard key 164, there is zero movement or circumferential displacement between the rail portion 104*a* of the upper receiver 104 and the rail portion 102*a* of the handguard 102. In other embodiments, in which the upper receiver 104 includes a receiver rail portion 104*a* and the handguard 102 does not include a rail portion, there is no movement or substantially no movement or circumferential displacement between the receiver rail portion 104*a* of the upper receiver 104 and the handguard 102.

Figure 5:
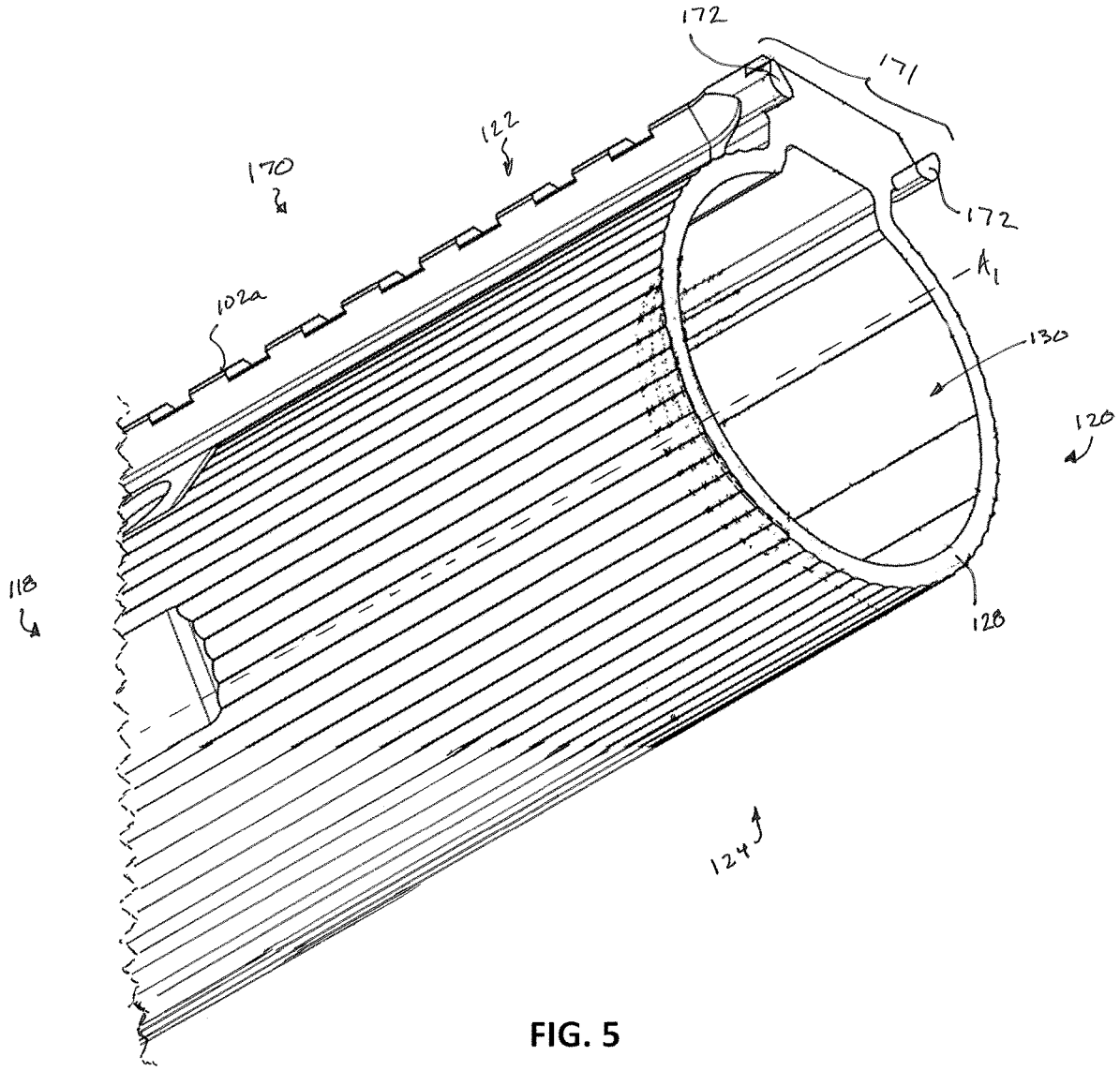
FIG. 5 illustrates a perspective view of an alternative example handguard with an integral handguard key.
Figure 6:
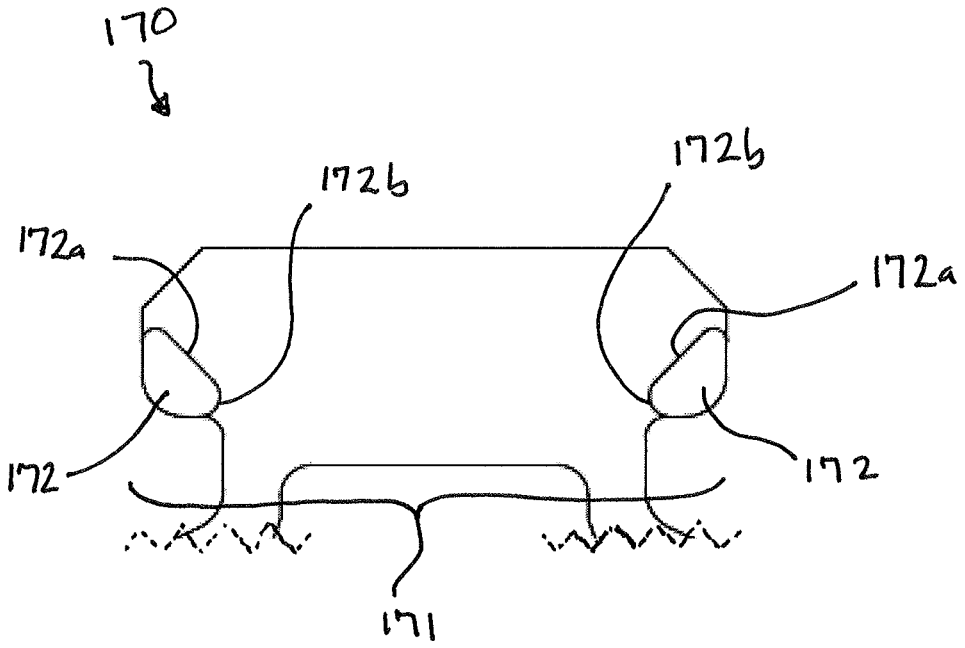
FIG. 6 illustrates a side view of the alternative example handguard with the integral handguard key configured to operate with the example firearm of FIG. 1.
Figure 7:
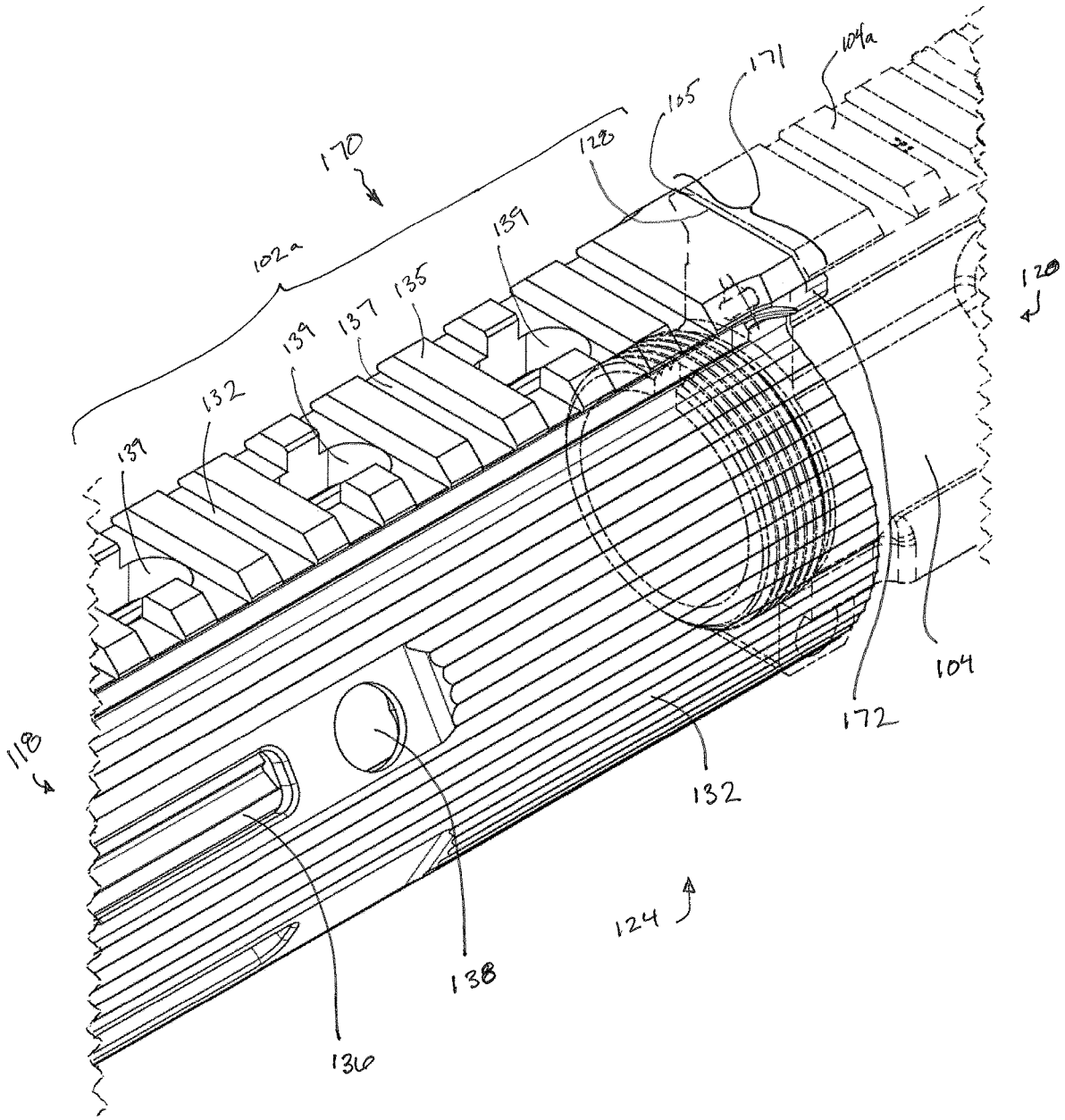
FIG. 7 illustrates a perspective view of the alternative handguard with the integral handguard key assembled to an upper receiver of the firearm.

FIG. 5 a perspective view of an alternative example handguard 170 with an integral handguard key 171, according to some embodiments of the present disclosure. FIG. 6 illustrates a side view of the handguard 170 with the integral handguard key 171, in which the handguard 170 is configured to operate with firearm 100, according to some embodiments of the present disclosure. FIG. 7 illustrates a perspective view of the handguard 170 with the integral handguard key 171 assembled to the upper receiver 104 of the firearm 100, according to some embodiments of the present disclosure. It is noted that the reference numbers illustrated in FIGS. 5-7 that have the same reference number illustrated in FIGS. 1-4 include the same features and embodiments discussed above. Accordingly, description of the elements with reference numbers in FIGS. 5-7 having corresponding reference numbers in FIGS. 1-4 will not be repeated. Moreover, it is noted that the features of the handguard 102 including the handguard key 164 are discussed in view of the handguard 102 being an example quad handguard. However, the features of handguard 102 and handguard key 164 may be implemented with handguards having various other shapes, including but not limited to a cylindrical shape such as that of the handguard 170 illustrated in FIGS. 5-7. Likewise, the features of the handguard 170 with the integral handguard key 171 are discussed in view of handguard 170 having a cylindrical shape. However, the features of handguard 170 and the integral handguard key 171 may be implemented in handguards having various other shapes, including but not limited to a quad rail shape such as that of handguard 102 depicted in the figures.

In some embodiments, the handguard 170 is machined to include the integral handguard key 171, in which the handguard 170 and integral handguard key 171 are of a unitary body. That is, the handguard 170 and the integral handguard key 171 may be a singular component.

In some embodiments, the integral handguard key 171 includes at least two end portions 172 that project rearwards from the back end 128 of the handguard 170. The at least two end portions 172 of the integral handguard key 171 extend in a direction parallel with the longitudinal axis A1 of the handguard 170. In one or more embodiments, the end portions 172 each extend from the back end 128 of the handguard 170 a length of about 0.05 inches to about 1 inch, such as about 0.06 inches to about 0.5 inches, or about 0.0625 inches to about 0.125 inches.

In one or more embodiments, each end portion 172 is configured in a variety of shapes, for example a "D" shape, a partial cylindrical shape, a partial rectangular shape, or other polyhedron shape. In some embodiments, each end portion 172 is configured with a variety of shaped interior surfaces, such as upper surface 172*a* and side surface 172*b*. In some embodiments, when the handguard 170 is mounted to the upper receiver 104, the at least two end portions 172 of the integral handguard key 171 engage the outer surface of the upper receiver 104 on the respective side of the top 122 of the firearm 100, thereby interlocking the handguard 170 and the upper receiver 104. In some embodiments, the at least two end portions 172 of the integral handguard key 171 engage the bottom surface of the rail portion 104*a*, for example, the bottom surface of the Picatinny rail, of the upper receiver 104. The upper surface portions 172*a* of the end portions 172 may engage the bottom surface of the rail portion 104*a* of upper receiver 104. Side surfaces 172*b* of end portions 172 may engage the vertical outer surface of upper receiver 104. The upper surface portions 172*a* of the end portions 172 may lie on a plane parallel with a plane of the bottom surface of the rail portion 104*a* of the upper receiver 104. The end portions 172 may be spaced a minimum of 0.617 inches apart from one another. In some embodiments, the minimum spacing for the end portions 172 may have a tolerance in accordance with the U.S. military standards for dimensions of accessory mounting rails. In some embodiments, the upper surface portions 172*a* is configured at or about a 45 degree angle to match the corresponding 45 degree angle of the bottom outer surface of the Picatinny rail of the upper receiver 104.

In some embodiments, by interlocking the handguard 170 and the upper receiver 104, the rail portion 104*a* of the upper receiver 104 and the rail portion 102*a* of the handguard 170 are automatically aligned when the handguard 170 and the upper receiver 104 are mounted to one another. In some embodiments, by interlocking the handguard 170 and the upper receiver 104, the handguard 170 is prevented from rotating in a clockwise or counterclockwise manner around a portion of the barrel 108 of the firearm 100. In some embodiments, when the handguard 170 is interlocked with the upper receiver 104 via the integral handguard key 171, there is zero movement or circumferential displacement between the rail portion 104*a* of the upper receiver 104 and the rail portion 102*a* of the handguard 170.

In other embodiments, the upper receiver 104 includes the receiver rail portion 104*a* and the handguard 170 does not include a rail portion. In such embodiments, the end portions 172 of the handguard 170 engage the rail portion 104*a* of the upper receiver 104 and prevent the handguard 170 from rotating in a circumferential direction around the longitudinal axis A1 of the handguard 170. In some embodiments, in which the upper receiver 104 includes a receiver rail portion 104*a* and the handguard 170 does not include a rail portion, the handguard 170 is prevented from rotating in a clockwise or counterclockwise manner around a portion of the barrel 108 of the firearm 100. In some embodiments, in which the upper receiver 104 includes a receiver rail portion 104*a* and the handguard 170 does not include a rail portion, there is no movement or substantially no movement or circumferential displacement between the rail portion 104*a* of the upper receiver 104 and the handguard 170.

As used herein, the term "about" in reference to a numerical value means plus or minus 15% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A method of aligning a rail portion provided on an upper outer surface of a handguard, the method comprising:

inserting a handguard key into a receiving portion of the handguard such that a proximal end portion of the handguard key interlocks with the receiving portion and a distal end portion of the handguard key projects beyond a back end of the handguard, wherein the proximal end portion of the handguard key comprises two projections that extend away from the proximal end in a proximal direction parallel to a longitudinal axis of the handguard along outer surfaces of the handguard such that the two projections directly engage a bottom, downward facing surface of the rail portion of the handguard; and mounting the handguard to a firearm such that the distal end portion of the handguard key interlocks with an outer surface of the firearm, wherein when the handguard is mounted to the firearm, the handguard key aligns the rail portion of the handguard with a rail portion provided on an upper, outer surface of the firearm.

2. The method of claim 1, wherein when the handguard is mounted to the firearm, the handguard key prevents the handguard from rotating in a circumferential direction around the longitudinal axis of the handguard.

3. The method of claim 1, further comprising fastening the handguard key to the receiving portion via a fastening member.

4. The method of claim 1, wherein the distal end portion of the handguard key comprises at least two end portions, each extending outwards from a central body of the handguard key, and wherein the at least two end portions are configured to engage the outer surface of the firearm.

5. The method of claim 1, wherein the rail portion of the firearm comprises a Picatinny rail.

6. The method of claim 1, wherein a portion of an upper surface of the distal end portion of the handguard key lies on a plane parallel with the outer surface of the firearm.

7. A firearm having a rail alignment system, the system comprising:

a receiver having a receiver rail portion provided on an upper, outer surface of the receiver; and a handguard coupled to the receiver, wherein the handguard comprises:

an elongate member comprising a central bore defining a longitudinal axis of the handguard;

a handguard rail portion provided on an upper, outer surface of the elongate member; and a handguard key provided on a back end of the elongate member, the handguard key having at least two end portions projecting away from the elongate member parallel to the longitudinal axis of the handguard, wherein the at least two end portions of the handguard key are configured to directly engage a bottom, downward facing surface of the receiver rail portion such that the handguard rail portion of the elongate member is aligned with the receiver rail portion.

8. The firearm of claim 7, wherein the handguard key is a modular handguard key configured to be removably attached to the handguard.

9. The firearm of claim 7, wherein the handguard is integrally formed with the handguard key, such that the handguard key and the handguard are of a unitary body.

10. The firearm of claim 7, wherein the at least two end portions projecting away from the elongate member are further configured to prevent the handguard from rotating in a circumferential direction around the longitudinal axis of the handguard.

11. The firearm of claim 7, wherein the handguard further comprises one or more tabs provided on the back end of the elongate member, the one or more tabs being configured to engage an outer surface of the receiver and to prevent the at least two end portions of the handguard key from bending in a direction that is not parallel with the longitudinal axis of the handguard.

12. The firearm of claim 7, wherein an upper surface of the at least two end portions of the handguard key lies on a plane parallel with the bottom surface of the receiver rail portion.

13. The firearm of claim 7, wherein an upper surface of the at least two end portions of the handguard key is formed at an angle of about 45 degrees and faces the receiver rail portion.

14. A handguard having an integral handguard key for a firearm, the handguard comprising:

an elongate member comprising a central bore defining a longitudinal axis of the handguard;

a rail portion provided on an upper, outer surface of the elongate member; and the integral handguard key provided on a back end of the elongate member, the integral handguard key having at least two end portions projecting away from the elongate member parallel to the longitudinal axis of the handguard, wherein when the handguard is mounted to the firearm having a rail portion provided on an upper, outer surface of the firearm, the at least two end portions of the integral handguard key are configured to directly engage a bottom, downward facing surface of the rail portion of the firearm and to align the rail portion of the elongate member with the rail portion of the firearm.

15. The handguard of claim 14, wherein the elongate member is integrally formed with the integral handguard key, such that the integral handguard key and the handguard are of a unitary body.

16. The handguard of claim 14, wherein, when the at least two end portions are engaged with an outer surface of the firearm, the at least two end portions are further configured to prevent the handguard from rotating in a circumferential direction around the longitudinal axis of the handguard.

17. The handguard of claim 14, wherein an upper surface of the at least two end portions of the handguard key lies on a plane parallel with the bottom surface of the rail portion of the firearm.

18. A handguard for a firearm, the handguard comprising:

an elongate member comprising a central bore defining a longitudinal axis of the handguard; and a handguard key provided on a back end of the elongate member, the handguard key having at least two end portions projecting away from the elongate member parallel to the longitudinal axis of the handguard, wherein when the handguard is mounted to the firearm having a rail portion provided on an upper, outer surface of the firearm, the at least two end portions of the handguard key are configured to lie on a plane parallel with a bottom, downward facing surface of the rail portion, and wherein the at least two end portions projecting away from the elongate member are further configured to directly engage the bottom surface of the rail portion and to prevent the handguard from rotating in a circumferential direction around the longitudinal axis of the handguard.

19. The handguard of claim 18, wherein the elongate member is integrally formed with the handguard key, such that the handguard key and the handguard are of a unitary body.

20. The handguard of claim 18, wherein the handguard key is a modular handguard key configured to be removably attached to the elongate member.

* * * * *